US005584147A

United States Patent [19]

Agee et al.

[11] Patent Number: 5,584,147

[45] Date of Patent: Dec. 17, 1996

[54] FREEZE-RESISTANT DOWNSPOUT SYSTEM

[75] Inventors: Ralph Agee, Liberty; Michael E. Jackson, Kansas City, both of Mo.

[73] Assignee: Butler Manufacturing Co., Inc., Grandview, Mo.

[21] Appl. No.: 540,072

[22] Filed: Oct. 6, 1995

[51] Int. Cl.[6] ..... E04D 13/064

[52] U.S. Cl. ..... 52/16; 52/302.1; 52/219; 52/741.1; 52/741.3; 138/32

[58] Field of Search ..... 52/16, 302.1, 741.3, 52/741.1, 169.5, 169.11, 220.8, 219; 138/32

[56] References Cited

U.S. PATENT DOCUMENTS

| | | | |
|---|---|---|---|
| 1,046,910 | 12/1912 | Wagner . | |
| 1,210,502 | 1/1917 | Lutton | 52/16 |
| 1,597,104 | 8/1926 | O'Donnell | 52/16 |
| 2,189,466 | 2/1940 | Huth | 138/32 |
| 2,602,764 | 7/1952 | Billingham | 138/32 X |
| 2,625,263 | 1/1953 | Kice | 138/32 X |
| 4,028,895 | 6/1977 | Franzmeir | 52/16 X |
| 4,142,565 | 3/1979 | Plunkett | 138/32 X |
| 5,010,700 | 4/1991 | Blair | 52/219 X |
| 5,303,517 | 4/1994 | Schneider . | |

*Primary Examiner*—Robert J. Canfield
*Attorney, Agent, or Firm*—Shoemaker and Mattare, Ltd.

[57] ABSTRACT

A freeze-resistant downspout system includes a metal downspout having an interior portion within a building and a contiguous exterior portion outside the building. The exterior portion is shielded from the weather by a thermally insulated shroud so that heat conducted along the downspout from within the building is sufficient to keep the exterior portion from freezing.

6 Claims, 4 Drawing Sheets

FREEZE-RESISTANT DOWNSPOUT SYSTEM

BACKGROUND OF THE INVENTION

This invention relates to building construction, and more particularly to a freeze-resistant downspout system.

In cold climates, downspouts can freeze up, so that water backs up in the gutters, overflowing them sometimes on the building side, whereupon water flows down or into the building. The weight of the accumulated ice and water can also damage the roof drainage system, or the roof itself, and falling gutters or downspouts are a danger to those below. Downspouts may also fail at their seams as ice expands within them.

There are a number of solutions to the freezing-gutter problem, none of them perfect. Downspouts may, for example, be electrically heated to prevent freezing. Another known method is to place the downspouts within the building, where it is warm, to keep them from freezing. When this approach is used, the gutters may also be placed inside, but then any gutter leaks become quite serious. The alternative is to have interior downspouts, but exterior gutters. Such an approach requires a through-wall connection between the gutters and the downspouts. That connection is the subject of this invention.

SUMMARY OF THE INVENTION

An object of the invention is to prevent downspout freezing, by placing the downspouts within a building, while preventing water leaks within the building.

Another object is to prevent ice damage to gutters, downspouts, and supporting structures.

Another object is to prevent an exterior downspout portion from freezing, even when outside temperatures are frigid, without using downspout heaters.

These and other objects are attained by a freeze-resistant downspout system including a metal downspout having an interior portion within a building and a contiguous exterior portion outside the building. The exterior portion is shielded by a thermally insulated shroud so that heat transferred along the downspout from within the building is sufficient to keep the exterior portion from freezing.

DESCRIPTION OF THE PREFERRED EMBODIMENT

Figure 1:
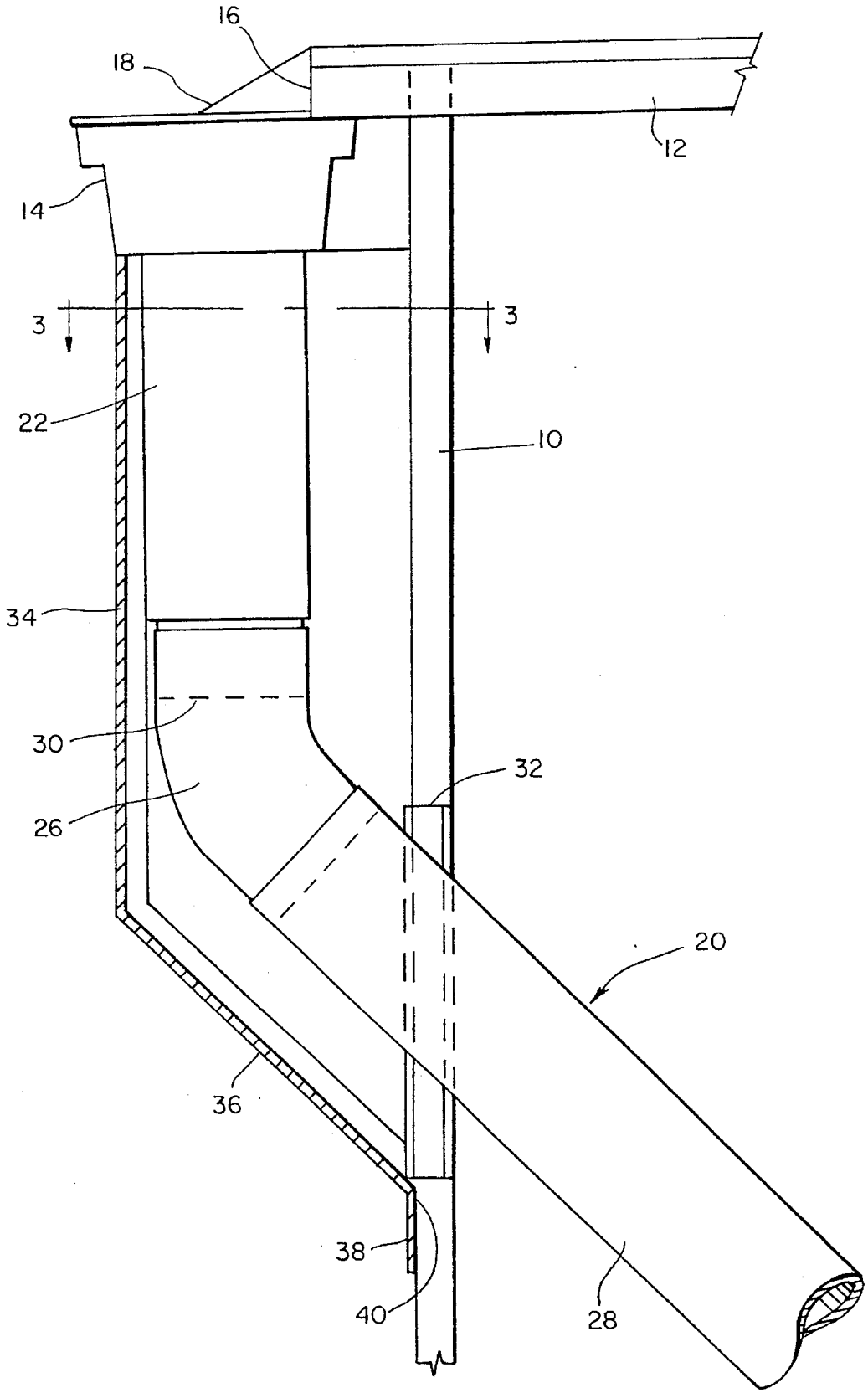
FIG. 1 is a side elevation, in partial section, of a freeze-resistant downspout system embodying the invention.
Figure 2:
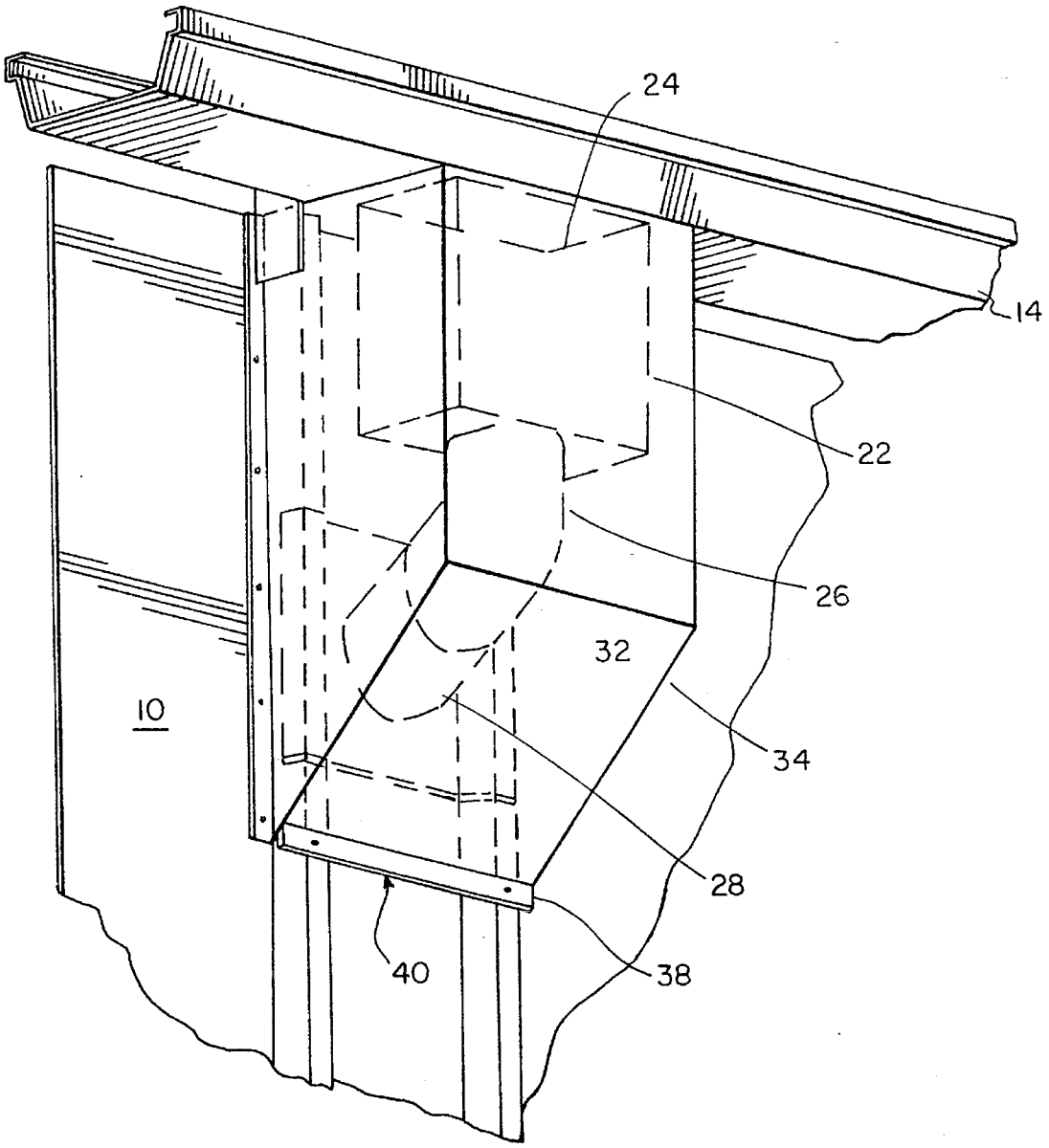
FIG. 2 is a perspective view thereof looking slightly upward and from the left.
Figure 3:
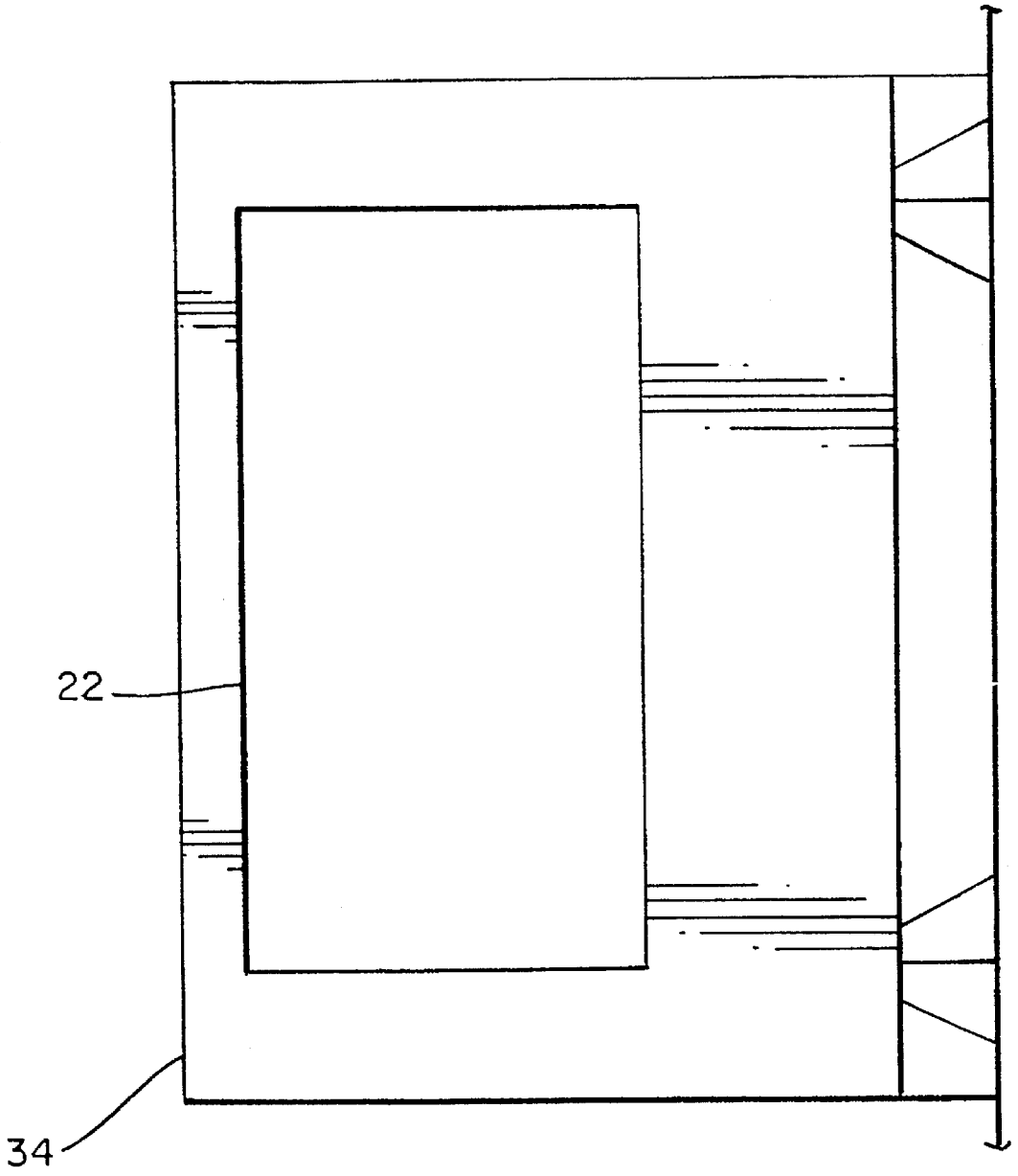
FIG. 3 is a section taken on the plane 3—3 in FIG. 1.

A freeze-resistant downspout system embodying the invention is shown in FIGS. 1–3.

Figure 4:
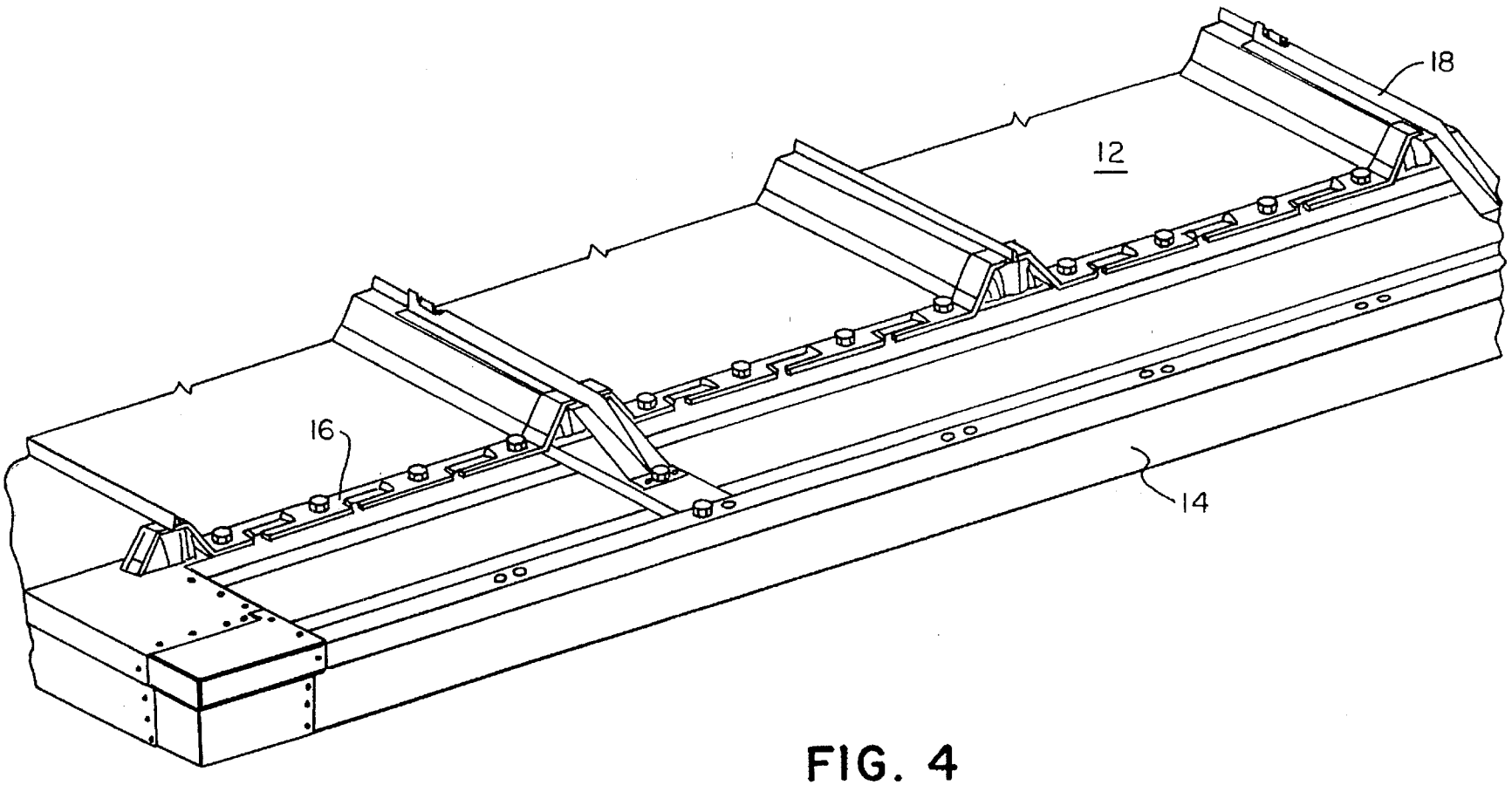
FIG. 4 is a perspective view from above of a gutter associated with the invention.

The building shown in FIGS. 1 and 2 has a wall 10 and a roof 12. A gutter 14 is attached to the eave 16 of the roof by bolts or screws along its inner edge, and by cantilever brackets 18 at its outer edge, as shown in FIG. 4. Water which collects in the gutter escapes through one or more downspouts 20, only one of which is shown in FIGS. 1 and 2. The upper end of the downspout terminates in a collector box 22, situated right below an opening 24 in the gutter, and affixed thereto by rivets or the like.

The collector box 22 is a rectangular parallelipiped, having an open top, a round opening in its bottom, and four vertical walls. A short collar 30 is welded or otherwise affixed to the bottom wall, around the opening.

The downspout has a 45° elbow 26 extending from a hole in the bottom of the collector box, and then a straight segment 28 which leads diagonally through the wall to a further downspout segment, not shown, connected to a storm sewer or the like. Thus, the uppermost portion of the downspout is outside the building, while the remainder is within the building, protected from the weather.

Where it passes through the wall, the downspout is supported by a wall jack 32, which is a reinforcing plate having a cross-sectional shape conforming to the wall corrugations. Besides supporting the downspout, the jack provides a weather seal where the downspout enters the building. The jack-to-wall interface is weather sealed, preferably by applying Butler Manufacturing Company's "Panlastic" tape sealant (a non-hardening butyl-based tape mastic) around the perimeter of the wall jack, between it and the building wall.

The collector box 22, the elbow 26, and the exterior part of the downspout segment 28—that is, the entire exterior portion of the downspout—are shielded from the weather by a shroud 34 having three vertical sides, and a sloping bottom 36 parallel to the axis of the straight segment. Consequently, the two parallel sides of the shroud are trapezoidal in shape. The top of the shroud is covered with a sheet metal closure (not shown) whose main purpose is to keep birds from nesting in the shroud. The bottom of the shroud has a vertical flange 38 which is affixed to two wall corrugations. There is a small open space 40 at the bottom, between the corrugations, to permit incidental drainage. The shroud is insulated all around with, for example, a one-inch layer 42 of rigid insulation such a "Thermax" board (a rigid polyisocyanate foam board having aluminum foil facings, produced by Celotex Corporation). The insulation is bonded to the interior surfaces of the shroud by an adhesive. The insulation helps keep the collector box and elbow above freezing.

The invention may be applied to an existing building by cutting a slot in the wall panel, for the downspout to pass through. A collector box is then installed on the gutter, laterally aligned with the slot. A tape sealant is then applied to the wall, around the opening, and a downspout is connected to the gutter box, with the straight segment passing through the slot. Now, the wall jack is attached to the wall using blind fasteners such as Butler Manufacturing Company's "Lock-Rivet" fasteners. Finally, the shroud is secured to the wall, around the collector box, by means of self-drilling screws.

During cold weather, the downspout conducts heat from within the building toward the gutter. This heating is usually sufficient, with the insulated shroud in place, to keep the portions of the downspout outside the building free of ice, without the use of an auxiliary heater.

The heat transfer rate may be increased, if desired, by removing some of the wall insulation around the point of wall penetration by the downspout. One could further increase the downspout heating by forming air passages through the wall, into the shrouded volume, so that there would be convective heat transfer as well as conduction.

Since the invention is subject to modifications and variations, it is intended that the foregoing description and the accompanying drawings shall be interpreted as only illustrative of the invention defined by the following claims.

I claim:

1. A freeze-resistant downspout system in combination with a heated building having at least one exterior gutter beneath an eave of the building, said system comprising at least one downspout connected to said gutter, said downspout having an interior portion within said building and a contiguous exterior portion outside said building, whereby heat is conducted along the downspout from within the building during cold weather, and a shroud affixed to an exterior wall of the building and enclosing said exterior downspout portion, said shroud having thermal insulation to retain heat transferred along the exterior downspout portion from within the building.

2. The invention of claim 1, wherein the shroud surrounds substantially all of the exterior portion of the downspout to protect it from the weather.

3. The invention of claim 2, wherein the shroud has interior surfaces, and the thermal insulation comprises board insulation affixed to said interior surfaces.

4. The invention of claim 2, further comprising a wall jack affixed to a wall of the building at a point where the downspout passes through the wall, to support the downspout and to provide a weather seal.

5. The invention of claim 3, wherein the wall jack is enclosed by said shroud.

6. A method of preventing freezing of a downspout, said method comprising steps of running an interior portion of the downspout within a heated building, and a contiguous exterior portion of the downspout outside the building, said exterior portion connected to a gutter, whereby heat is conducted from the interior portion to the exterior portion during cold weather, and shielding the exterior portion from the weather with an insulated shroud to preserve the heat transferred along the downspout from within the building and thus prevent freezing of the exterior portion, said shielding comprising affixing said shroud to an exterior wall of said building to enclose the exterior portion of the downspout.

* * * * *